United States Patent [19]

Kwok

[11] Patent Number: 4,972,903

[45] Date of Patent: Nov. 27, 1990

[54] HEAT EXCHANGER

[75] Inventor: Tai W. Kwok, Bartlesville, Okla.

[73] Assignee: Phillips Petroleum Company, Bartlesville, Okla.

[21] Appl. No.: 470,659

[22] Filed: Jan. 25, 1990

[51] Int. Cl.[5] ..... F28F 9/02; F28F 9/22

[52] U.S. Cl. ..... 165/158; 165/159; 165/175

[58] Field of Search ..... 165/158, 159, 175, 176

[56] References Cited

U.S. PATENT DOCUMENTS

| | | | |
|---|---|---|---|
| 2,061,980 | 11/1936 | Price | 165/158 |
| 2,213,410 | 9/1940 | Rathbun | 165/158 X |
| 2,492,409 | 12/1949 | Worn et al. | 165/159 X |
| 2,900,173 | 8/1959 | Pickford | 165/158 X |
| 4,105,065 | 8/1978 | Chirico | 165/78 |

FOREIGN PATENT DOCUMENTS

| | | | |
|---|---|---|---|
| 83247 | 4/1935 | Sweden | 165/159 |

OTHER PUBLICATIONS

*Applied Process Design for Chemical and Petrochemical Plants,* Ernest E. Ludwig, Gulf Publishing Company, 1965, pp. 14–17, 24.

*Unit Operations,* George Granger Brown, John Wiley & Sons, Inc., 1950, pp. 422–425.

*Elements of Chemical Engineering,* Walter L. Badger and Warren L. McCake, McGraw-Hill Book Company, Inc., 1936, pp. 162–165.

*Primary Examiner*—Martin P. Schwadron

*Assistant Examiner*—Allen J. Flanigan

*Attorney, Agent, or Firm*—Charles W. Stewart

[57] ABSTRACT

A shell-and-tube heat exchanger with a tube sheet having false partition grooves which allows the periodic rotation of a removable heat exchanger tube bundle, as well as a method of performing such rotation.

8 Claims, 5 Drawing Sheets

HEAT EXCHANGER

BACKGROUND OF THE INVENTION

This invention relates generally to shell-and-tube heat exchangers having improved tube sheet and front-end head designs.

In industry, heat transfer methods form an important part of almost all chemical processes. One of the most commonly used pieces of heat transfer equipment is the shell-and-tube type heat exchanger. Descriptions of the various types of heat exchangers are summarized in many well known publications, see generally, 1 Perry's Chemical Engineers'Handbook. chap. 11 at 3–21 (Green, 6th ed. 1984), and do not need to be fully described here. Generally, this type of heat exchanger comprises a bundle of tubes and a head having an inlet nozzle in fluid flow communication with an outlet nozzle. The tube bundle is enclosed in a shell that enables one fluid to flow into contact with the tube bundle and to transfer heat from or to another fluid flowing through the tubes in the bundle.

Shell-and-tube heat exchangers may be used in essentially all types of functional services such as condensing, cooling, vaporizing, evaporating, and mere exchanging of heat energy between two different fluids. Furthermore, shell-and-tube exchangers are capable of handling practically any types of chemical compounds including, for example, water, steam, hydrocarbons, acids, and bases. In the design of a shell-and-tube heat exchanger, there are a myriad of mechanical and process factors to take into account in order to generate an economically optimum heat exchanger design. Many of these desirable design factors, however, have off-setting negative results which impose limits on the extent to which a certain design factor may be used. For instance, it is generally desired to maximize the amount heat transferred in an exchanger and, to achieve this, a designer will attempt to increase the heat transfer surface and to maximize the fluid velocity in both the tube-side and the shell-side of the exchanger. But, by increasing the surface area of a heat exchanger and the fluid velocities, the economic cost of exchanger materials escalates and the cost of pumping a fluid through the exchanger increases. Because of these conflicting considerations, a designer must optimize the design of a heat exchanger by comparing the incremental value of the heat recovered to the incremental cost associated with recovering the additional heat energy. The point where the incremental costs and incremental values are equivalent will provide the economic optimum exchanger design.

Another design consideration is the quality and nature of the fluids being handled and their effect on the corrosion, fouling, and scaling of the exchanger surfaces. Fouling is the deposition of material upon the heat transfer surfaces of a heat exchanger. These deposited materials usually have low thermal conductivities which create large thermal resistances thereby lowering the heat transfer coefficient. Having a surface with a high heat transfer coefficient is beneficial in that it provides a greater rate of heat transfer and allows for a more economical heat exchanger equipment design.

One approach to minimizing the rate of fouling of a heat exchanger is to design for high liquid or gas velocities. The disadvantage, however, of designing for high velocities is that the pressure drop across a heat exchanger increases exponentially with increases in velocity which results in increasing fluid pumping costs.

Moreover, greater erosion damage of the heat exchanger surfaces is caused by the higher fluid velocities. Because of these negative consequences, heat exchanger design specifications provide for both a minimum fluid velocity flow and a maximum acceptable velocity flow.

When a shell-and-tube type heat exchanger is used as either a vaporizer or as a condenser, either one or both of the fluids passing through the heat exchanger undergo a phase change. Because of this phase change, the volumetric flow rate changes as gas or liquid passes through the heat exchanger. This change in volumetric flow rate results in a change in fluid velocity; and, in the case of a condensing fluid, its velocity will decrease as it passes through the exchanger creating a greater potential for fouling, scaling, or corrosion problems which are associated with low tube-side fluid velocities. In the case where a fluid is being vaporized, its volumetric velocity will increase as it passes through the exchanger creating a greater potential for erosion.

One approach to addressing the problems related to low tube side fluid velocities is to provide for multiple tube passes. This multi-pass type heat exchanger construction provides for an improvement in the heat transfer coefficient through the increase in fluid velocity by decreasing the cross-sectional area of the fluid path. A multi-pass heat exchanger is constructed by building into the head and return ends of a heat exchanger baffles or partitions which direct the fluid through the tubes into their proper relative positions.

The most common multi-pass heat exchanger construction is to arrange for an equal number of tubes per pass; however, if the physical changes in the fluid volumes warrant, a heat exchanger may be designed so that there are an unequal number of tubes per pass. By providing for a heat exchanger with an unequal number of tubes per pass, a heat exchanger can be designed to maintain a relatively even fluid velocity distribution throughout the length of the exchanger tubes even though there is a phase change in the fluid as it passes through the tubes. By controlling the fluid velocity on the tube-side of an exchanger, all of the various design considerations such as fouling, scaling, corrosion, erosion, heat transfer coefficients, and pressure drop can be optimized.

In spite of the various advantages which may accrue from the use of multiple-tube pass exchangers, there are certain disadvantages, which have not been resolved by the art, to using these types of heat exchangers where they are of the type having removable tube bundles. It is sometimes desirable to periodically rotate a heat exchanger tube bundle about its longitudinal axis 180° in order to prolong the useful life of the tubes. This procedure of rotating the exchanger bundle is somewhat analogous to rotating the tires on an automobile in order to prolong the useful life of the tires through a more even distribution of wear. Particularly, where a heat exchanger is being used in a highly corrosive and stressful service, it is important to rotate the tube bundle to allow for a more even distribution of the corrosive, erosive, and other stresses. However, if the heat exchanger is one having equal or unequal numbers of tubes per pass, the tube bundle cannot be rotated as desired because of the unsymmetrical flow pattern.

SUMMARY OF THE INVENTION

It is an object of this invention to provide an apparatus which allows for the optimal design of a shell-and-tube heat exchanger for the condensing of vapors and the vaporization of liquids.

Another objective of this invention is to provide an apparatus which helps to increase the useful life of a shell-and-tube heat exchanger.

A further objective of this invention is to provide a shell-and-tube heat exchanger containing equal or unequal numbers of tubes per tube-side pass, but which also allows for the periodic rotation of the tube bundle while maintaining the same fluid flow distribution through the tubes after said rotation.

The present invention is an improvement upon a typical shell-and-tube heat exchanger of the type having a removable tube bundle. The improvement involves false partition grooves formed in the face of the exchanger tube sheet which allows the periodic rotation of the tube bundle of an exchanger which has multiple tube passes and having either equal or unequal numbers of tubes per pass.

BRIEF DESCRIPTION OF THE DRAWINGS

Other aspects, objects, and advantages of this invention will become apparent from a study of this disclosure, appended claims, and the drawings in which:

DETAILED DESCRIPTION OF THE INVENTION

Figure 1:
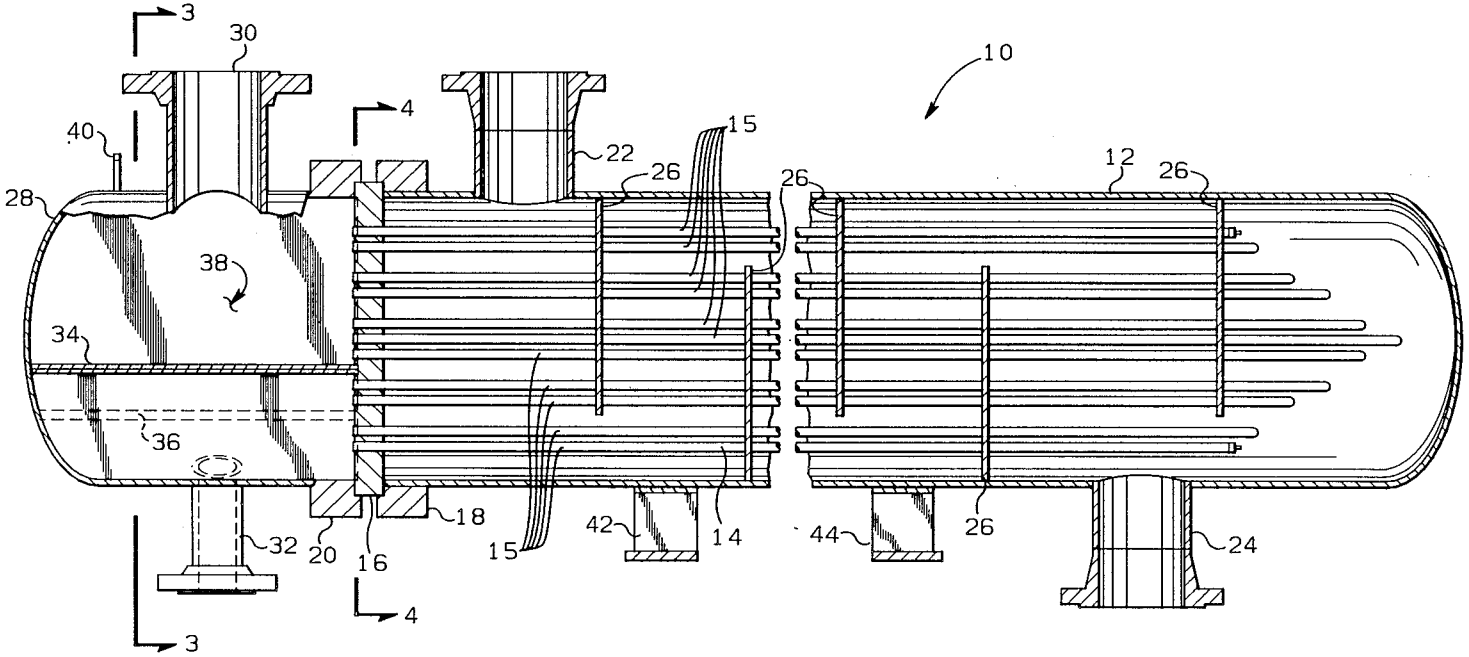
FIG. 1 is an elevational view of a shell-and-tube heat exchanger with portions thereof broken away to illustrate certain features of the present invention.

FIG. 1 depicts a shell-and-tube heat exchanger 10 comprising shell 12 and tube-bundle 14. The tube bundle 14 is composed of a plurality of U-shaped tubes 15 affixed to tube sheet 16 by any commonly used technique for rolling tubes inside drilled tube holes or apertures. Tubes 15 of tube bundle 14 and tube sheet 16 may be arranged in any commonly used regular pattern such as in a triangular pitch or a square pitch and they can be made of a variety of materials which can include, for example, steel, copper, monel, admiralty brass, 70–30 copper-nickel, aluminum bronze, aluminum, and the stainless steels. The preferred embodiment, however, is to arrange tubes 15 in a square pitch pattern and to fabricate tubes 15 from a monel material. As shown in FIG. 1, tube bundle 14 is of the removable, U-tube type having a single tube sheet 16, but this invention is not limited to U-tube type construction and may be of any type of construction which allows for the removal of the tube bundle from the shell, including floating head type bundles. Tube sheet 16 is held in place by shell flange lB and channel flange 20 which are suitably secured together by a plurality of threaded bolts (not shown).

Shell 12 is provided with nozzles 22 and 24 spaced as shown to induce flow of shell-side fluid across and along the external length of the tubes of tube bundle 14. This one-pass, shell-side fluid flow is the preferred arrangement under the embodiment of this invention, and generally, it is the most commonly used flow arrangement in typically designed shell-and-tube heat exchangers. Other shell-side flow arrangements are possible such as a split-flow, double split-flow, divided flow and cross flow that require either additional nozzles or different nozzle arrangements or both. Tube bundle 14 is equipped with segmental type baffles 26, spaced at convenient distances, which improve heat transfer by inducing turbulent fluid flow and causing the shell-side fluid to flow at right angles to the axes of tubes 15 of tube bundle 14. Segmental baffles 26 are made from segments of circular, drilled plates which allow the insertion of the exchanger tubes. The diameter of the segmental baffles 26 approaches that of the inner diameter of shell 12 and approximately twenty-five percent of each baffle 26 is cut out and removed from the drilled plate. The cut-out portions of the baffles 26 are alternately rotated 180° about the longitudinal axis of the tube shell 12 so as to provide an up-and-down, side-to-side or zig-zag type fluid flow pattern across tube bundle 14. While the preferred embodiment of this invention uses twenty-five percent cut segmental baffles, there are other types which may be used such as disc and donut baffles, rod baffles, orifice baffles, double segmental baffles, and triple segmental baffles.

Figure 2:
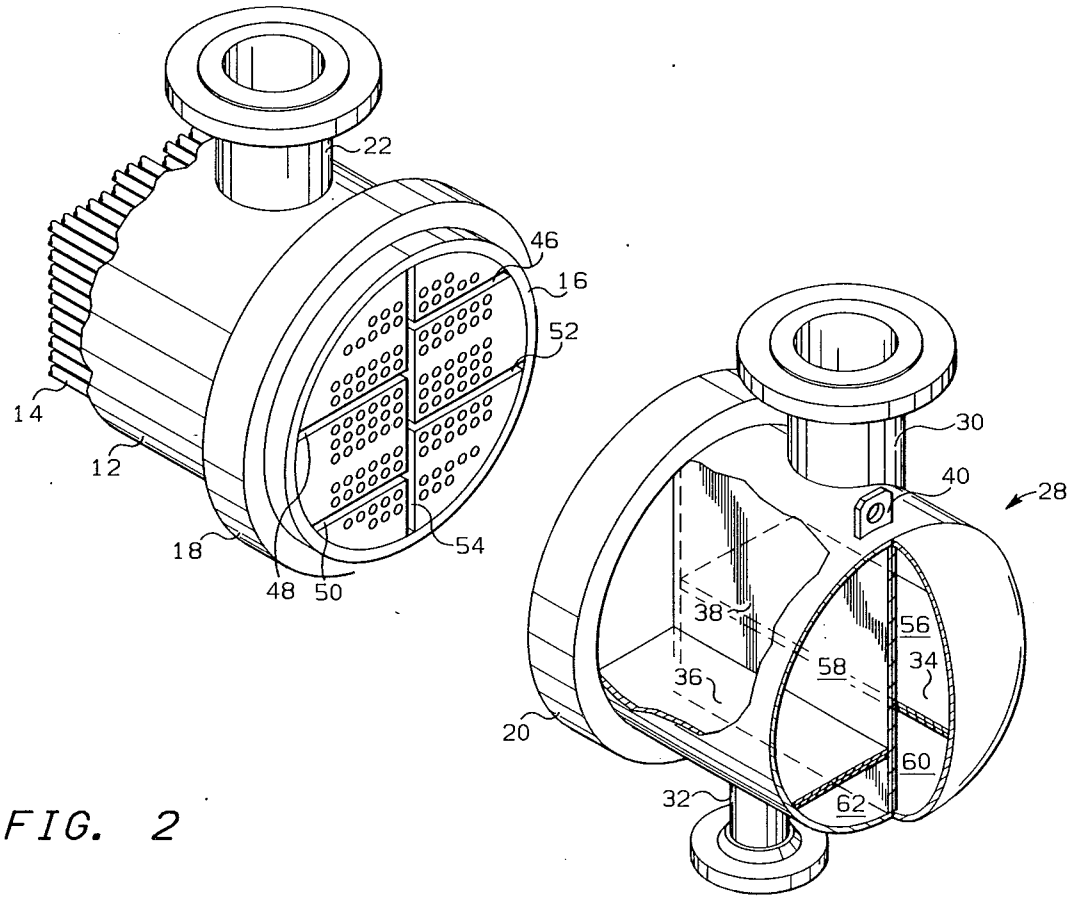
FIG. 2 is an isometric exploded view of the heat exchanger of FIG. 1 illustrating the tube bundle, the tube sheet, and the front-end head thereof which includes the features of the present invention.
Figure 3:
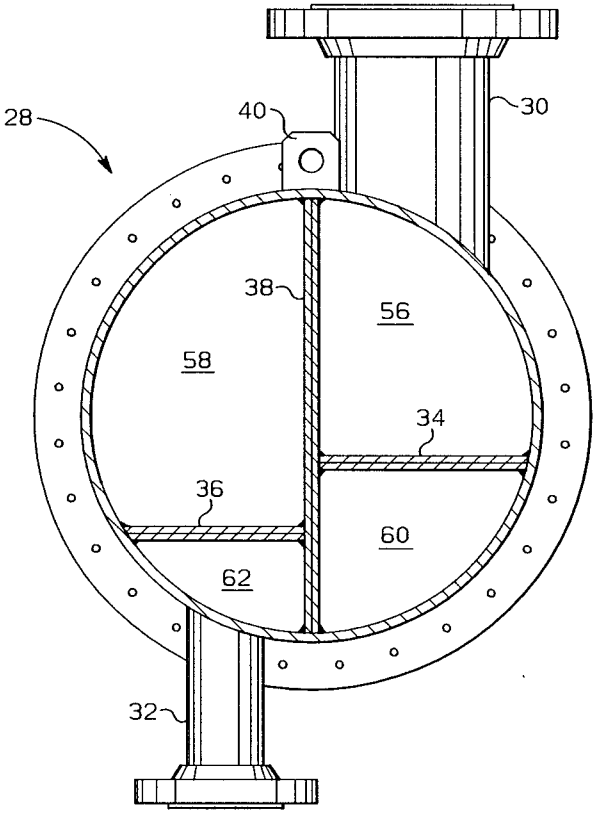
FIG. 3 is a cross sectional view taken along line 3—3 of FIG. 1 showing the inside of the front-end stationary head of the shell and tube heat exchanger of the present invention.
Figure 4:
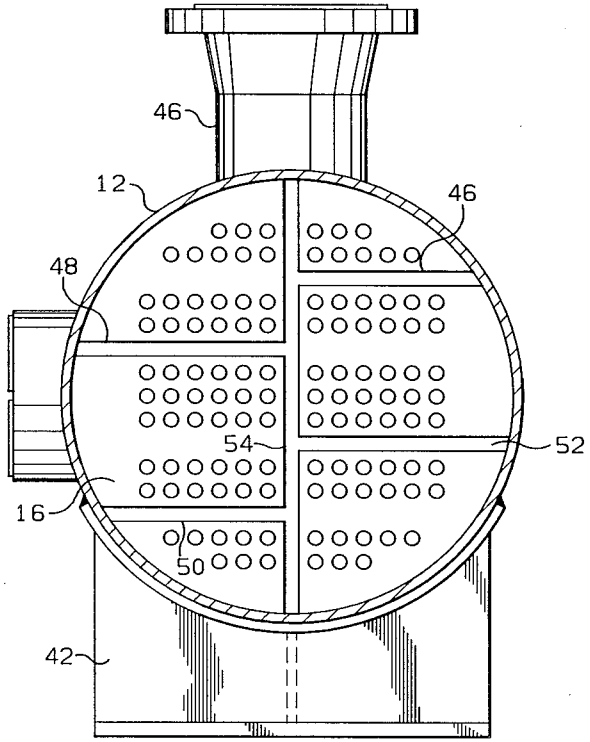
FIG. 4 is a cross sectional view taken along line 4—4 of FIG. 1 illustrating the tubesheet design and configuration which is a feature of the present invention.

A stationary front-end bonnet head or front-end head 28, having inlet nozzle 30, outlet nozzle 32, two horizontally oriented pass partitions 34 and 36, and one vertically oriented pass partition 38, is equipped with channel flange 20 for assembly with shell 12 by bolts (not shown) passing through channel flange 20 and opposing shell flange 18. While it is generally preferred to use bolts and flanges as a fastener means, any other suitable means such as clamps and latches for connecting stationary front-end bonnet head 28 and shell 12 with tube sheet 16 therebetween may be used. Flanges 18 and 20 clamp on tube sheet 16, which is designed in accordance with this invention, in a closed position. The joints between the outer edges of the pass partitions and the partition grooves in the tube sheet 16 are formed by inserting the outer edge of horizontal pass partition 34 into horizontal partition groove 52, the outer edge of horizontal pass partition 36 into horizontal partition groove 50, and the outer edge of vertical pass partition 38 into vertical partition groove 54, as best shown in FIG. 2, FIG. 3 and FIG. 4. The joints are sealed with a gasket (not shown) and with force created by the torquing of the threaded bolts which connect channel flange 20 and shell flange 18. Bonnet head 28 is fitted with lifting lug 40. The shell 12 is provided with support saddles 42 and 44 for support and mounting upon a foundation.

FIG. 2 shows the lay-out of tube sheet 16 having a boundary edge and a group of five partition grooves 46, 48, 50, 52 and 54 formed thereon and showing bonnet head 28 with pass partition plates 34, 36 and 38 along with an inlet nozzle 30 and an outlet nozzle 32. Horizontal pass partition grooves 46 and 48 are false grooves in that they are formed on the face of tube sheet 16 merely to allow for the rotation of tube bundle 14 through an angle of 180° about its center or longitudinal axis, which intersects the vertical center line of tube sheet 16, while still maintaining the same fluid flow distribution through the tubes. The center or longitudinal axis of tube sheet 16 is defined as an imaginary line perpendicular to the face of tube sheet 16 which passes axially therethrough and is parallel to tubes 15 that are affixed to tube sheet 16 and which intersects the vertical centerline of tube sheet 16. The vertical centerline of tube sheet 16 is defined as an imaginary line parallel to the faces of tube sheet 16 which divides the faces of tube sheet 16 into two symmetrical halves and which intersects the center or longitudinal axis. Upon the face of tube sheet 16 is formed a vertical partition groove 54 which extends vertically across the face of tube sheet 16 parallel to the vertical centerline with both ends of vertical partition groove 54 intersecting the boundary edge of tube sheet 16. Both horizontal partition grooves 50 and 52 and horizontal false partition grooves 46 and 48 extend normally from the vertical centerline to the outer boundary edge of tube sheet 16.

The partition plates 34, 36 and 38 are fixedly secured inside bonnet head 28 either by welding or casting in place or any other suitable means. These partition plates serve to direct the fluid flow through the tubes in a specific pattern as, for example, required by a changing fluid phase as the fluid passes through the heat exchanger tubes 15. While FIG. 2 shows the preferred embodiment of this invention providing for a six-pass heat exchanger having an unequal number of tubes per pass. This invention, however, can be extended to heat exchangers having any even number of tube-side passes with equal or unequal numbers of tubes per pass. Furthermore, this invention can be extended to heat exchangers that use floating-head type tube bundles as described hereinbelow.

FIG. 2 and the cross-sectional views of FIG. 3 and FIG. 4 illustrate the fluid flow through the heat exchanger tubes, the apparatus of the invention and its operation. In operation of the heat exchanger 10, vapor to be condensed enters exchanger 10 through inlet nozzle 30 into first chamber 56 within bonnet head 28 where the vapor accumulates and then flows into a portion of tubes 15 contained within tube sheet 16 comprising the first tube pass. Because tubes 15 are of the U-tube type design, the incoming vapor passes through tubes 15 of the first tube pass and returns to enter second chamber 58 in bonnet head 28 via the second tube pass. Within second chamber 58, the fluid loops around and enters the third tube pass where the fluid passes axially down the length of tubes 15 of the third tube pass and returns to enter third chamber 60 in bonnet head 28 via the fourth tube pass. Within third chamber 60, the fluid makes another loop to enter the fifth tube pass where it flows axially down the length of tubes 15 and returns via the sixth tube pass to enter the fourth chamber 62 in bonnet head 28. From fourth chamber 62, the condensed fluid exits the chamber via outlet nozzle 32. As the vapor passes through tubes 15 of exchanger 10 and tube bundle 14 it undergoes the condensation process where at any given position within the fluid flow path, there will be some mixture of vapor and liquid. As a result of this condensation process, the fluid volumetric flow rate changes as it passes through the heat exchanger causing a reduction in fluid velocity. Providing for an unsymmetrical and unequal number of tubes per tube pass allows for the adjustment and optimization of the tube-side fluid flow velocities.

The two so-called horizontal false pass partition grooves 46 and 48 that are incorporated in tube sheet 16 allow for the periodic rotation of tube bundle 14 through an angle of 180° about its center axis as earlier defined. In operating this invention, after an appropriate period of use, tube bundle 14 is removed from shell 12 and rotated through an angle of 180° about its center axis and subsequently replaced in the new rotated position. As tube bundle 14 is rotated 180° around its center axis, horizontal false pass partition groove 46 is repositioned in the previous position held by horizontal pass partition groove 50 and pass partition groove 48 is repositioned in the previous position held by horizontal pass partition groove 52. Thus, after rotation, horizontal pass partition grooves 50 and 52 become horizontal false pass partition grooves and horizontal false pass partition grooves 46 and 48 become the grooves required for forming a joint and seal wiih the ends of partition plates 34 and 36. Pass partition groove 54 forms the joint seal with the end of partition plate 38 in both the original and the rotated positions of the tube bundle 14.

Figure 5:
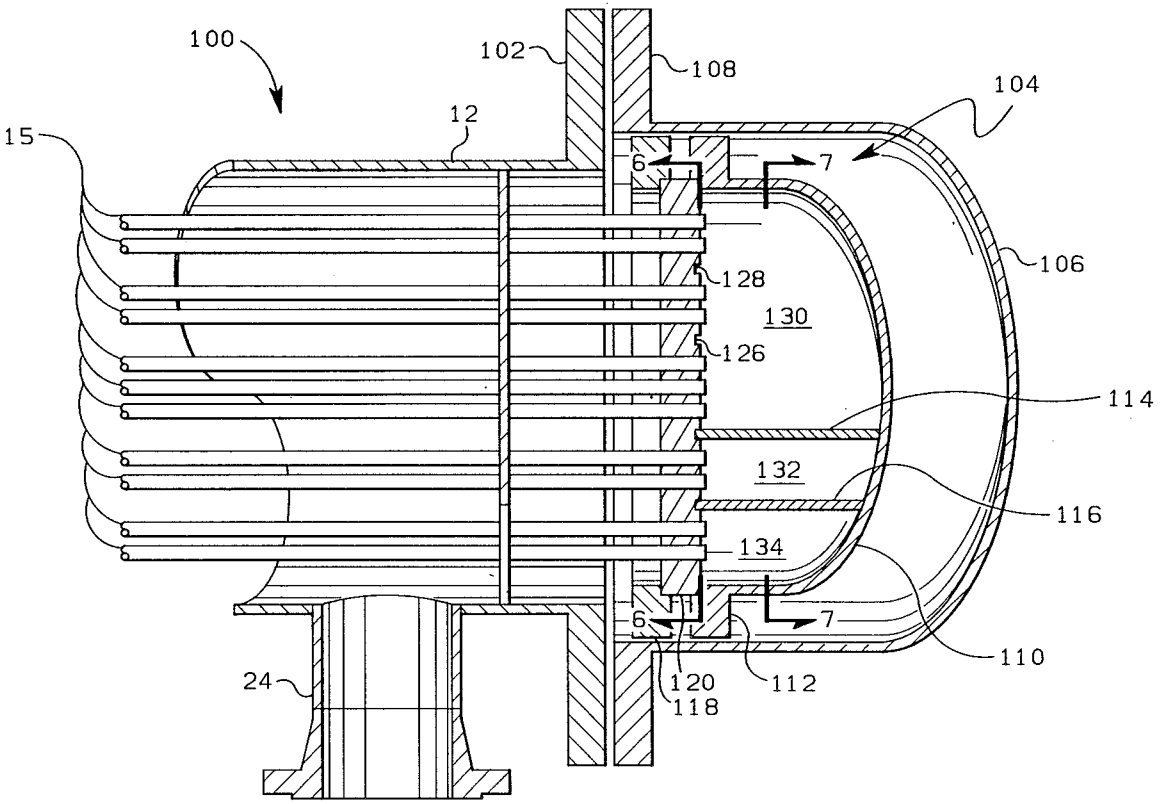
FIG. 5 is an elevational view of a shell-and-tube heat exchanger with portions thereof broken away to illustrate certain features of the present invention.

In FIG. 5 is illustrated an embodiment of the invention wherein is depicted the rear-end head section of a floating head type heat exchanger 100 as opposed to the U-tube type heat exchanger 10 of FIG. 1 as previously referred to. All the elements indicated in the heat exchanger 10 of FIG. 1 are substantially similar to those of the heat exchanger 100 with several exceptions. Shell 12 is equipped at its rear end with a shell flange 102. The tube bundle is a floating head type with floating head assembly 104. There is a shell cover 106 that is provided with a shell cover flange 108 for assemblyly with shell 12 by bolts (not shown) passing through shell cover flange 108 and opposing shell flange 102.

Floating head assembly 104 comprises a floating head cover 110 having a floating head flange 112 and two horizontal partition plates 114 and 116. Further provided with floating head assembly 104 is a floating head backing device 118. The floating head backing device 118 is used in conjunction with floating head flange 112 to engage and secure in place tube sheet 120 against floating head cover 110 and to bring horizontal partition plates 114 and 116 in registration with tube sheet 120. The floating head cover 110 serves as a return cover for the tube side fluid. While it is generally preferred to use as a fastener means a backing ring such as the floating head backing device 118 with bolts to secure tube sheet 120 and floating head cover 110 in place, any other suitable means can be used. For example, the floating head cover 110 can be bolted directly onto tube sheet 120 without the assistance of a backing ring.

Figure 6:
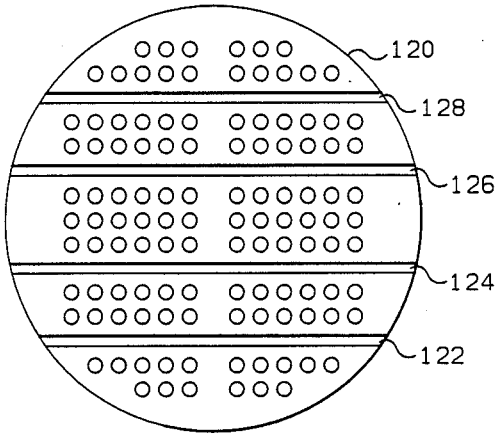
FIG. 6 is a cross sectional view taken along line 6—6 of FIG. 5 illustrating the tube sheet design and configuration which is a feature of the present invention.

FIG. 6 is a cross sectional view taken along line 6—6 of FIG. 5 showing one face of tube sheet 120. The tubes 15 are affixed to tube sheet 120 by a substantially similar technique to that used for affixing the tubes to tube sheet 16 shown in FIG. 1, FIG. 2, and FIG. 4. Formed in tube sheet 120 are four horizontal partition grooves 122, 124, 126, and 128 which extend horizontally across the face of tube sheet 120 parallel to the horizontal centerline with both ends of each horizontal partition groove intersecting the boundary edge of tube sheet 120. Tube sheet 120 has an imaginary vertical centerline, an imaginary horizontal centerline and a center or longitudinal axis. These imaginary centerlines are defined as lines parallel to the faces of tube sheet 120 that divide the faces of tube sheet 120 into symmetrical halves. The imaginary horizontal centerline divides tube sheet 120 in the horizontal direction and the imaginary vertical centerline divides tube sheet 120 in the vertical direction. The intersection of the horizontal imaginary centerline and the vertical imaginary centerline is also the intersection point of the center axis, which is an imaginary line perpendicular to and passing through the face of tube sheet 120. Center axis runs parallel to tubes 15 that are affixed to both tube sheet 120 and tube sheet 16. The center axis of tube sheet 120 is substantially the same center axis as that of tube sheet 16.

Among the four partition grooves of tube sheet 120, horizontal partition grooves 122 and 124 are formed in tube sheet 120 in a position parallel to the imaginary horizontal centerline so that, when floating head cover 110 is secured in place with floating head backing device 118 with tube sheet 120 therebetween, joints between the outer edges of the horizontal partition plates and the horizontal partition grooves can be formed by inserting the outer edges of horizontal partition plates 114 and 116 into horizontal partition grooves 124 and 122, respectively. The joints can generally be sealed with a gasket (not shown) and with force created by the torquing of the threaded bolts (not shown) which pass through floating head flange 112 and floating head backing device 118. This assembly creates three fluid return chambers 130, 132, and 134. The remaining horizontal partition grooves 126 and 128 are horizontal false partition grooves in that they are formed on the face of tube sheet 120 merely to allow for the rotation of tube bundle 14 through an angle of 180° about its center axis, as earlier defined, while still maintaining the same fluid flow distribution through the tubes.

Figure 7:
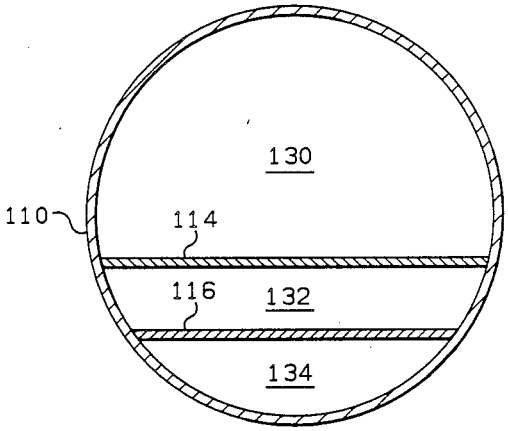
FIG. 7 is a cross sectional view taken along line 7—7 of FIG. 5 showing the inside of the floating head of the shell and tube heat exchanger of the present invention.

FIG. 7 is a cross sectional view taken along line 7—7 of FIG. 5 showing an elevational view of the inside of floating head cover 110. The horizontal partition plates 114 and 116 are fixedly secured inside floating head cover 110 either by welding or casting in place or any other suitable means. These partition plates serve to direct the tube-side fluid flow through the tubes in a specific pattern as determined by the front-end stationary head design. The horizontal partition plates 114 and 116 are positioned so as to be horizontally aligned with the horizontal pass partitions 34 and 36 shown in FIG. 1, FIG. 2, and FIG. 3. As depicted in FIG. 5, FIG. 6 and FIG. 7, the preferred embodiment provides for a six-pass exchanger having an unequal number of tubes per pass. This invention, however, can be extended to heat exchangers having any even number of tube-side passes with equal or unequal numbers of tubes per pass.

In the operation of heat exchanger 100, tube-side fluid passing from first chamber 56 of front-end head 28 as shown in FIG. 1, FIG. 2 and FIG. 3 via the associated tubes enters chamber 130. Within chamber 130, the fluid flow direction is reversed so as to return the fluid to the tubes and to pass the fluid by way of the tubes into second chamber 58 of front-end head 28. Within second chamber 58, the fluid flow changes direction and enters the tubes whereby the fluid passes into chamber 132 in which the fluid is returned to the tubes to pass by way of the tubes into third chamber 60. Within third chamber 60, the fluid makes another change in direction and enters the tubes whereby the fluid passes into chamber 134 by which the fluid is once again returned to the tubes to make a final pass into fourth chamber 62. From fourth chamber 62, the condensed fluid exits the chamber via outlet nozzle 32.

As earlier described and as shown in FIG. 5, there are two so-called horizontal false partition grooves 126 and 128 incorporated in tube sheet 120. These grooves allow for the periodic rotation of tube bundle 14 through and angle of 180° about its center axis, as earlier defined. In operating this invention, after an appropriate period of use, the tube bundle 14 is removed or withdrawn from shell 12 prior to its rotation This removal is accomplished first by removing shell cover 106 followed by the removal of floating head cover 110 so as to permit the bundle 14 with its tube sheet 120 to slide through the interior of shell 12 as the tube bundle is pulled outwardly from the front-end of heat exchanger 100. In the case where an embodiment of this invention includes a pull-through type floating head heat exchanger wherein floating head cover 110 is secured directly to tube sheet 120 without the use of a backing device means similar to that of floating head backing device 118, the tube bundle can be withdrawn from shell 12 without removing shell cover 106 or floating head cover 110.

EXAMPLE I

Figure 8:
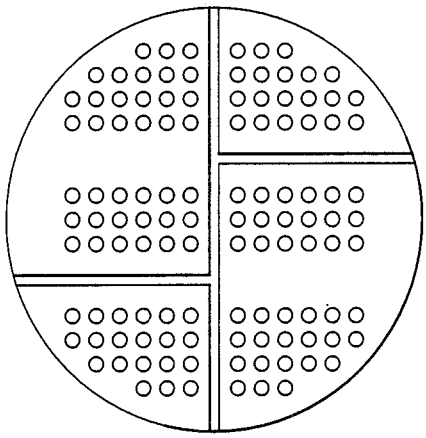
FIG. 8 is an elevational view of a typical tube sheet of a six-pass shell-and-tube heat exchanger providing for an essentially even number of tubes per pass.

Table I is provided to show the benefits which can be achieved by using the disclosed invention. Shown in Table I are calculated heat exchanger values for a given flow rate within the tube side of a typical symmetrically oriented six-pass heat exchanger the tube sheet of which is illustrated in FIG. 8 (shown in "Before" column) and for a heat exchanger having an unequal number of tubes per pass as has been illustrated in FIG. 1, FIG. 2 and FIG. 4 (shown in "After" column) both being operated as a vapor condenser. The calculated values presented in Table I apply to a type BEU exchanger (i.e., bonnet head, one pass shell, U-tube bundle heat exchanger) having 58 U-tubes with each tube comprising two essentially straight tube lengths with a radius section connecting each length. The tubes are 1 inch O.D. ×12 BWG (Birmingham Wire Gauge) U-tubes oriented in a 1 ¼ inch square pitch pattern with the "Before" exchanger having 20 tube lengths in the first and second passes, 18 tube lengths in the third and fourth passes, and 20 tube lengths in the fifth and sixth passes. The "After" exchanger has 38 tube lengths each in passes one and two, 12 tube lengths each in passes three and four, and 8 tube lengths each in passes five and six. As reflected in Table I, the flow velocity of the entering vapor is substantially higher than the flow velocity of the exiting condensed liquid. By reorienting the fluid flow through the exchanger tubes, a more preferred velocity distribution within the tubes can be obtained. The vapor velocity is lowered and the liquid velocity is increased thus helping to reduce erosion caused by the high vapor velocities and to reduce fouling caused by low liquid velocities. Furthermore, the overall heat transfer coefficient is improved due to an improvement in velocity distribution. By having the ability to rotate the tube bundle in accordance with the present invention at convenient time periods, the useful life of the heat exchanger tubes is increased resulting in a reduction in various capital and operating costs related to the heat exchanger.

TABLE I (Calculated)
Pertinent calculated values for a typical conventional symmetrical six-pass heat exchanger and a nonsymmetrical six-pass heat exchanger incorporating an artificial or false pass partition groove in tube sheet in accordance with the present invention.

| | Before Inventive Feature | After Inventive Feature |
|---|---|---|
| Vapor in (lb/hr) | 10,791 | 10,791 |
| Volumetric flow in ($ft^3$/sec) | 4.82 | 4.82 |
| Vapor velocity in (ft/sec) | 72.2 | 37.0 |
| Liquid out (lb/hr) | 10,791 | 10,791 |
| Volumetric flow out ($ft^3$/sec) | 0.124 | 0.124 |
| Liquid velocity in (ft/sec) | 1.85 | 4.11 |
| Estimated Overall Heat-Transfer Coefficient (BTU/hr/ft/°F.) | 50 | 55 |
| Tube life extension by rotation of bundle (years) | 2 to 3 | 4 to 6 |

While this invention has been described in detail for the purpose of illustration, it is not to be construed or limited thereby, but it is intended to cover all changes and modifications within the spirit and scope thereof.

That which is claimed is:

1. A shell-and-tube heat exchanger for transferring heat energy from one fluid to another fluid which comprises:

a shell;

a removable tube bundle for use in said shell-and-tube heat exchanger comprising a first tube sheet having a first face, a second face, a boundary edge, a vertical centerline, an uninterrupted vertical partition groove formed in said first face along said vertical centerline and intersecting the boundary edge at each end of said vertical partition groove, said vertical partition groove dividing said first face into a first symmetrical half and a second symmetrical half, a horizontal partition groove formed in said first symmetrical half of said first face and aligned normal to said vertical centerline and extending from said vertical partition groove to intersect the boundary edge, a horizontal false partition groove formed in said second half of said first face normal to said vertical centerline and extending from said vertical partition groove to intersect the boundary edge, said horizontal partition groove being so positioned in said second half of said first face such that when said first tube sheet is rotated through an angle of 180° about a center axis perpendicular to said first face and intersecting said vertical centerline, said horizontal false partition groove is positioned in the same location as said horizontal partition groove prior to such rotation of said first tube sheet about said center axis through an angle of 180°, and a plurality of apertures formed in said first tube sheet in a symmetrical pattern with each said apertures communicating between said first face and said second face, and a plurality of tubes connected in fluid flow communication with said corresponding plurality of apertures and extending away from said second face;

a first head having a wall with an inside surface and an outside surface and comprising an inlet nozzle on said wall and communicating between said inside surface and said outside surface for receiving a fluid, a vertical partition plate attached to said inside surface of said first head for directing said fluid through said plurality of tubes of said removable bundle, a horizontal partition plate attached to both said inside surface of said first head and to said vertical partition plate for directing said fluid through said plurality of tubes of said removable bundle, and an outlet nozzle on said wall and communicating between said inside surface and said outside surface of said first head, and in fluid flow communication with said inlet nozzle via said plurality of tubes; and first fastener means for connecting said first head to said shell and for securing said vertical partition plate in registration with said vertical partition groove of said first face and for securing said horizontal partition plate in registration with said horizontal partition groove of said first symmetrical half of said first face.

2. A shell-and-tube heat exchanger as recited in claim 1 wherein:

said horizontal partition groove and said horizontal false partition groove do not have a common axis.

3. A shell-and-tube heat exchanger as recited in claim 1 wherein said removable tube bundle further comprises:

a second tube sheet having a first face, a second face, a boundary edge, a vertical centerline in parallel with said vertical centerline of said first tube sheet, a horizontal centerline dividing said second tube sheet into a first symmetrical half and a second symmetrical half, a second horizontal partition groove formed in said first symmetrical half of said first face of said second tube sheet and in a position parallel to said horizontal partition groove of said first tube sheet and extending fully across said first face of said second tube sheet intersecting said boundary edge of said second tube sheet at two locations, a second horizontal false partition groove formed in said second symmetrical half of said first face of said second tube sheet parallel to said horizontal partition groove of said first face of said first symmetrical half of said second tube sheet and extending fully across said first face of said second tube sheet and intersecting said boundary edge of said second tube sheet at two locations, said second horizontal false partition groove being so positioned in said second symmetrical half of said first face of said second tube sheet such that when said second tube sheet is rotated through an angle of 180° about a center axis perpendicular to said first face and intersecting said vertical centerline, said second horizontal false partition groove of said second tube sheet is positioned in the same location as said second horizontal partition groove of said second tube sheet prior to such rotation of said second tube sheet about said center axis through an angle of 180°, and a plurality of apertures formed in said second tube sheet in a symmetrical pattern with each said apertures communicating between said first face and said second face; and said plurality of tubes connected in fluid flow communication with said corresponding plurality of apertures of said second tube sheet and extending away from said second face of said second tube sheet.

4. A shell-and-tube heat exchanger as recited in claim 3 further comprising:

a second head having a wall with an inside surface and comprising a second horizontal partition plate attached to said inside surface of said second head for directing said fluid through said plurality of tubes of said removable tube bundle; and second fastener means for connecting said second head to said second tube sheet and for securing said second horizontal partition plate of said second head in registration with said second horizontal partition groove of said second tube sheet.

5. A method of operating a shell-and-tube heat exchanger of the type as defined in claim 1 wherein said vertical partition plate is in registration with said vertical partition groove of said first face and with said horizontal partition plate in registration with said horizontal partition groove of said first face which comprises:

(a) removing said removable tube bundle from said shell of said shell-and-tube heat exchanger, (b) rotating said removable tube bundle about said center axis through an angle of 180° relative to said shell and said first head, and (c) replacing said removable tube bundle into said shell in its newly rotated position with said vertical partition plate in registration with said vertical partition groove of said of said first face and with said horizontal partition plate in registration with said horizontal false partition groove of said first face.

6. A method of operating a shell-and-tube heat exchanger of the type as defined in claim 3 wherein said vertical partition plate is in registration with said vertical partition groove of said first face and with said horizontal partition plate in registration with said horizontal partition groove of said first face which comprises:

(a) removing said removable tube bundle from said shell of said shell-and-tube heat exchanger, (b) rotating said removable tube bundle about said center axis through an angle of 180° relative to said shell and said first head, and (c) replacing said removable tube bundle into said shell in its newly rotated position with said vertical partition plate in registration with said vertical partition groove of said of said first face and with said horizontal partition plate in registration with said horizontal false partition groove of said first face.

7. A method of operating a shell-and-tube heat exchanger of the type as defined in claim 4 wherein said vertical partition plate is in registration with said vertical partition groove of said first face and with said horizontal partition plate in registration with said horizontal partition groove of said first face which comprises:

(a) disconnecting said second head from said second tube sheet, (b) removing said first head from said shell of said shell-and-tube heat exchanger, (c) removing said removable tube bundle from said shell of said shell-and-tube heat exchanger, (d) rotating said removable tube bundle about said center axis through an angle of 180° relative to said shell, said first head of said shell and said second head, (e) reconnecting said second head to said second tube sheet by said second fastener means thereby securing said second horizontal partition plate of said second head in registration with said second false horizontal partition groove of said second tube sheet, (f) replacing said removable tube bundle into said shell in its newly rotated position, and (g) reconnecting said first head to said shell by said first fastener means thereby securing said first vertical partition plate in registration with said vertical partition groove and securing said horizontal partition plate in registration with said horizontal false partition groove.

8. A method of operating a shell-and-tube heat exchanger of the type as defined in claim 4 wherein said vertical partition plate is in registration with said vertical partition groove of said first face and with said horizontal partition plate in registration with said horizontal partition groove of said first face which comprises:

(a) removing said removable tube bundle from said shell of said shell-and-tube heat exchanger, (b) disconnecting said second head from said second tube sheet, (c) rotating said removable tube bundle about said center axis through an angle of 180° relative to said shell said first head of said shell and said second head, (d) reconnecting said second head to said second tube sheet by said fastener means thereby securing said second horizontal partition plate of said second head in registration with said second false horizontal partition groove of said second tube sheet, (e) replacing said removable tube bundle into said shell in its newly rotated position, and (f) reconnecting said first head to said shell be said first fastener means thereby securing said first vertical partition plate in registration with said vertical partition groove and securing said horizontal partition plate in registration with said horizontal false partition groove.

* * * * *